US008955691B2

(12) United States Patent
Lister

(10) Patent No.: US 8,955,691 B2
(45) Date of Patent: Feb. 17, 2015

(54) SPIRAL RAMP HYDROCYCLONE

(75) Inventor: Roy D. Lister, Winston Salem, NC (US)

(73) Assignee: Jason E. Bramlett, Cypress, TX (US)

( * ) Notice: Subject to any disclaimer, the term of this patent is extended or adjusted under 35 U.S.C. 154(b) by 629 days.

(21) Appl. No.: 13/374,348

(22) Filed: Dec. 22, 2011

(65) Prior Publication Data

US 2013/0048556 A1 Feb. 28, 2013

Related U.S. Application Data

(60) Provisional application No. 61/575,836, filed on Aug. 30, 2011.

(51) Int. Cl.
*B04C 5/081* (2006.01)
*B04C 5/103* (2006.01)

(52) U.S. Cl.
CPC ..... *B04C 5/081* (2013.01); *B04C 5/103* (2013.01)
USPC ..... 210/512.1; 210/788; 209/727; 209/734

(58) Field of Classification Search
USPC ..... 210/512.1, 788; 209/727, 734
See application file for complete search history.

(56) References Cited

U.S. PATENT DOCUMENTS 4,711,720 A 12/1987 Young
4,857,197 A 8/1989 Young et al.
4,876,016 A 10/1989 Young et al.
4,927,536 A 5/1990 Worrell et al.
4,964,994 A 10/1990 Wakley et al.
5,110,471 A * 5/1992 Kalnins ..... 210/512.1
5,225,082 A 7/1993 Young et al.
5,843,211 A 12/1998 Bielefeldt
5,965,021 A 10/1999 Hesse et al.
6,238,569 B1 5/2001 Favret, Jr.
6,398,973 B1 6/2002 Saunders et al.
6,730,236 B2 5/2004 Kouba
6,743,359 B1 * 6/2004 Smyth et al. ..... 210/512.1

OTHER PUBLICATIONS

Guy R. Carriere and Roy D. Lister, "Produced Water Treatment for Combined Oil and Sand Removal", First EXPOIND Symposium of Engineering of E & P—BC Petrobras, in Imbetiba-Macae-RJ, Sep. 29, 1999, 12 pages (including 7 pages of text and 5 pages of figures).
Roy D. Lister, "Oil Field Applications of Hydrocyclones, Production Separation Systems", IBC USA Conference, Nov. 17, 1997, pp. 1-10, Houston, Texas.

(Continued)

*Primary Examiner* — David A Reifsnyder
(74) *Attorney, Agent, or Firm* — Edward Eugene Thigpen

(57) ABSTRACT

The invention comprises a hydrocyclone separator which includes a first segment including a fluid inlet, an overflow outlet and a spiral fluid ramp having a first and second end. The first end of the spiral fluid ramp is in fluid communication with and extends from the fluid inlet. The second end of the spiral fluid ramp is connected in fluid communication with the wider end of a frustoconical second segment and the narrower end of the frustoconical second segment is connected in fluid communication with a first end of a third segment comprising a tubular element. An underflow outlet is located at the second end of said tubular element.

5 Claims, 3 Drawing Sheets

(56) References Cited

OTHER PUBLICATIONS

G. A. Young, W. D. Wakley, D. L. Taggart, S. L. Andrews, J. R. Worrell, "Oil-Water Separation Using Hydrocyclones an Experimental Search for Optimum Dimensions", American Filtration Society, Oct. 29, 1990, Baton Rouge, Louisiana, 31 pages (induding title page, 13 pages of text and 17 pages of figures).

Roy Lister and Fred Rodriguez, "Ongoing Studies and Results with Hydrocyclones", 3rd Annual Produced Water Seminar American Filtration Society, Jan. 21, 1993, 15 pages (including 10 pages of text and 5 pages of figures), Houston, Texas.

Grant Young, Davis Taggart, David Hild, "Improved Understanding of Deoiling Hydrocyclones Leads to Significant Performance Improvement", Amoco Production Company Research Department—Tulsa Production Research Division, Dec. 23, 1973, title page and pp. 1-3.

Guy R. Carriere, Fred Rodriguez, Roy D. Lister, "Comparison of Oil/Water Separation Results between Coalescing/Gas Sparging and Hydrocyclone Systems for Produced Water Applications", 6th Annual Produced Water Seminar, Jan. 18-19, 1996, Clear Lake, Texas, 7 pages (including title page, 4 pages of text and 2 pages of figures).

Guy R. Carriere and Roy D. Lister, "Liquid/Liquid Hydrocyclones and Coalescing Technology for Produced Water Applications", publicly available on or before Dec. 31, 1999, 4 pages.

* cited by examiner

SPIRAL RAMP HYDROCYCLONE

CROSS-REFERENCE TO RELATED APPLICATIONS

This applications is a non-provisional application which claims benefit under 35 USC §19(e) to U.S. Provisional Application Ser. No. 61/575,836, filed on Aug. 30, 2011, entitled "Ramp Entry Hydrocyclone".

STATEMENT REGARDING FEDERALLY SPONSORED RESEARCH OR DEVELOPMENT

Not applicable

BACKGROUND OF THE INVENTION

1. Field of the Invention

The present invention relates to hydrocyclone separators.

2. Background of the Invention

Hydrocyclones may be utilized for separating a liquid-solid mixture, a gas-liquid mixture, or a mixture of two liquids. Hydrocyclones have been found to be useful, for example, for the separation of an oil-water mixture.

When crude oil is extracted from the Earth's subsurface, the oil that is brought to the surface is typically contaminated with water and may also be contaminated with other substances. Before the oil is refined, the water must be substantially removed from the oil to allow the oil to be transported through a pipeline.

Because the separation of the water from the oil is never entirely complete, the water that is removed from the oil will still contain some amount of oil. Before this water can be reintroduced into the environment, the water must be treated to remove at least enough of the oil to meet environmental concerns. With increasingly stringent environmental regulations, the standards for water purity that must be met before the water can be returned to the environment are increasing.

One system utilized for treating the separated water to remove the residual oil employs a hydrocyclone, which uses centrifugal force to separate the oil from the water. The hydrocyclone is an apparatus that comprises a frustoconical shaped segment, into which the mixed flow to be separated is placed, via an inlet, into the wider end of the frustoconical shaped segment. As the fluid passes towards the narrower end of the frustoconical segment, a vortex is created, which causes the denser water phase of the mixture to be flung outwards while the lighter oil phase is displaced to the center of the frustoconical shaped segment.

A hydrocyclone will typically include a cylindrical tubular first segment that is contiguous with the opening at the wider end of a frustoconical shaped second segment, and a cylindrical tubular third segment that is contiguous with and extends from the narrower end of the frustoconical shaped segment. In order to produce the velocity and the centrifugal forces necessary for separation of the two substances, hydrocyclones have typically used a tangential entry opening into the first cylindrical tubular segment. The design of the hydrocyclone causes the entering fluid to begin spinning around the walls of the hydrocyclone, accelerating the fluid and converting the pressure of the incoming fluid into centrifugal force, up to several thousand times the force of gravity at the bottom of the frustoconical segment. The heavier material (the water) is forced outward in the cone and discharges through the underflow, typically located at the lower end of the cylindrical tubular third segment, while the lighter material (oil) moves toward the center and is discharged through the overflow, typically at the upper end of the cylindrical tubular first segment.

SUMMARY OF THE INVENTION

The invention comprises a hydrocyclone separator which includes a first segment including a fluid inlet, an overflow outlet and a spiral fluid ramp having a first and second end. The first end of the spiral fluid ramp is in fluid communication with and extends from the fluid inlet. The second end of the spiral fluid ramp is connected in fluid communication with the wider end of a frustoconical second segment and the narrower end of the frustoconical second segment is connected in fluid communication with a first end of a third segment comprising a tubular element. An underflow outlet is located at the second end of said tubular element. In a particular embodiment of the invention the spiral fluid ramp is tapered.

DESCRIPTION OF A PREFERRED EMBODIMENT

Figure 1:
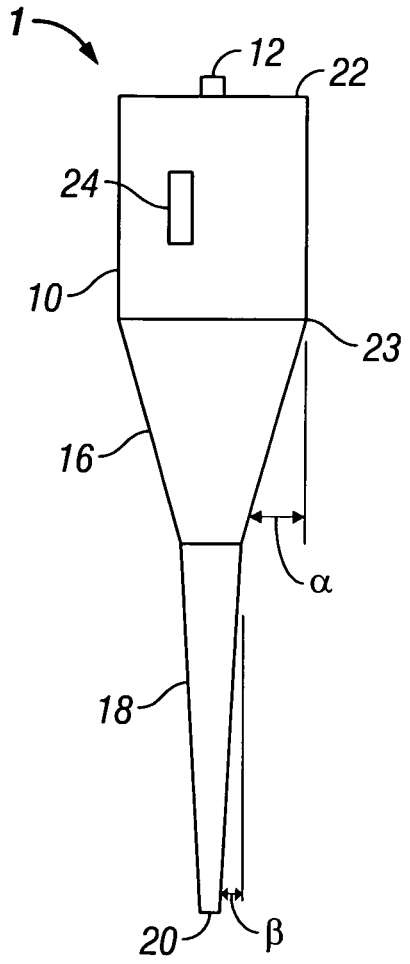
FIG. 1 shows a hydrocyclone in accordance with the present invention

As shown in FIG. 1, a hydrocyclone separator 1 of the present invention can include a first segment 10, which may be substantially cylindrical, having a central overflow outlet 12 at a first end 22 thereof, and a flow inlet 24. A second end 23 of the first segment 10 converges into frustoconical shaped second segment 16, which in turn converges into the substantially tubular third segment 18, which has a central underflow outlet 20, that is oppositely located with respect to the overflow outlet 12. Hydrocyclones are normally constructed from one or a combination of three main materials: polyurethane polymers, 316L stainless steel or duplex stainless steel. The hydrocyclone separator can be assembled from multiple separate parts that are bolted, clamped, welded, or glued together to form a single hydrocyclone separator, or it can be molded as a single unit from PVC, polyurethane or other similar material.

Figure 2:
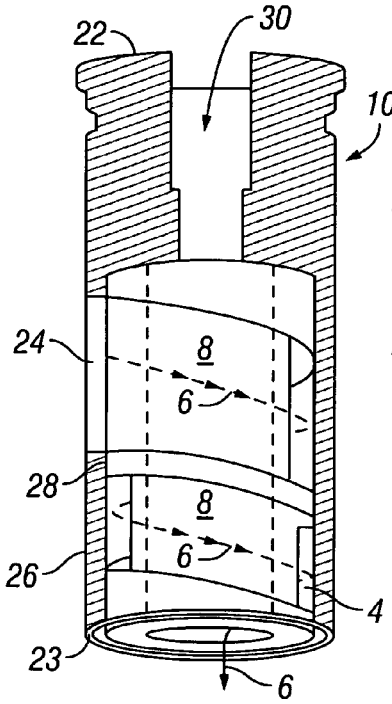
FIG. 2 shows a first segment of the hydrocyclone in partial cross-section
Figure 3:
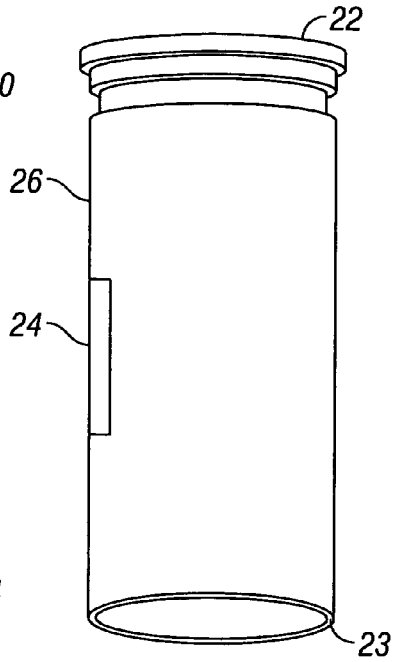
FIG. 3 shows the substantially cylindrical outer portion of the first segment of the hydrocyclone.
Figure 4:
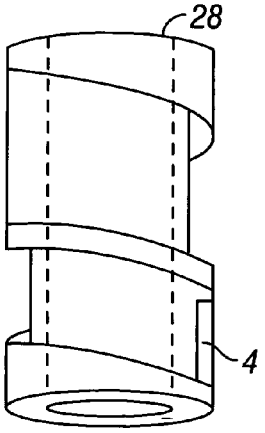
FIG. 4 shows a further portion of the first segment of the hydrocyclone.

First segment 10, which comprises tubular element 26 and spiral ramp element 28, is shown in more detail in FIGS. 2, 3, 4 and 5. FIG. 3 shows tubular element 26, and FIG. 4 shows spiral ramp element 28. FIG. 2 shows tubular element 26, in cross section, with spiral ramp element 28 inserted therein, to create spiral ramp 8. The fluid mixture exits spiral ramp 8 through flow exit 4 into frustoconical shaped segment 16. In a preferred embodiment, the cross-sectional area of spiral ramp 8 is tapered, which achieves an increase in the speed of the fluid flow as the fluid mixture exits flow exit 4.

The fluid mixture enters flow inlet 24 and follows a spiral flow path, as indicated by dashed arrows 6, within spiral ramp 8. The fluid mixture exits the spiral ramp 8 through flow exit 4 and flows into frustoconical shaped segment 16. A spiral flow pattern is established for the fluid mixture as it flows down spiral ramp 8, which achieves partial separation of the lighter fluid from the heavier fluid before the fluid mixture enters the frustoconical shaped segment 16. This spiral flow is continued in frustoconical shaped segment 16. As the fluid mixture flows downwardly in the frustoconical shaped segment 16, the fluid flow velocity accelerates which causes a greater centrifugal force on the fluid mixture, further increasing the separation of the lighter fluid from the heavier fluid. In a particular embodiment of the invention the slope $\alpha$ of the frustoconical shaped segment 16 may be about six degrees.

As the fluid mixture flows down spiral ramp 8, a centrifugal force is generated in the fluid, which initiates the separation of the lighter component from the heavier component of the fluid mixture. The centrifugal force generated in the frustoconical shaped segment 16 causes further separation of the lighter component from the heavier component. The lighter component is driven to the center of the spiraling fluid mixture by the heavier component, and the lighter component travels upwardly through the center 30 of spiral ramp element 28 and tubular element 26.

As shown in FIG. 1, the tubular segment 18 extends from frustoconical shaped segment 16. Tubular segment 18 may be a right cylinder; however, in a preferred embodiment of the invention, tubular segment 18 may have a cone angle $\beta$ of less than six degrees, and in a particular embodiment the cone angle $\beta$ may be less than one degree. As the swirling fluid flows down tubular segment 18 the cone angle $\beta$ will further enhance the separation of the lighter component from the heavier component of the fluid mixture. The heavier component is propelled to outside of the vortex and exits through underflow opening 20. The lighter component is propelled to the center of the vortex and rises through the center of spiral ramp element 28 and tubular element 26.

With reference to FIGS. 2 and 3, spiral ramp 8 is matched to the entrance opening of flow inlet 24, so that the fluid mixture entering spiral ramp 8 does not encounter an abrupt directional change as the fluid mixture flows through flow inlet 24 and enters the spiral ramp 8. By avoiding an abrupt directional change, any turbulence that would result from the fluid mixture entering the spiral ramp is diminished. In a particular embodiment the walls of the ramp 8 as they extend from flow inlet 24 are in the form of a parallelogram. In one preferred implementation of the invention, the diameter of a circle having the same area as the cross-sectional area of flow inlet 4 may be substantially equal to one-fourth (¼) of the diameter of the wider end of frustoconical-shaped segment 16.

The use of a spiral ramp, in accordance with the present invention, wrapped around the interior of cylindrical first segment 10 provides a longer entry path, within a limited space, into frustoconical shaped segment 16, which achieves a decreased turbulence level as the fluid mixture flows through the spiral ramp 8 to enter the frustoconical shaped segment 16. A lower turbulence results in maintaining larger-sized oil droplets and thereby achieves a more efficient separation of the fluids in the hydrocyclone. In this embodiment of the invention, the spiral ramp 8 provides a long conduit into frustoconical shaped segment 16, but limits the entry conduit into the frustoconical shaped segment 16 to a small, normally rectangular, opening. Further, the tapering results in an increased fluid flow velocity as the fluid mixture enters frustoconical shaped segment 16. The spiral flow path also achieves partial separation of the lighter fluid from the heavier fluid before the fluid mixture enters the frustoconical shaped segment 16.

Figure 5:
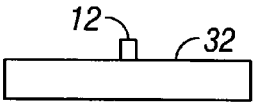
FIG. 5 shows the top portion of the first segment of the hydrocyclone.

Cylindrical first segment 10 also includes a cap 32, shown in FIG. 5, which forms the first end 22 of first segment 10, and includes central overflow outlet 12.

Figure 6:
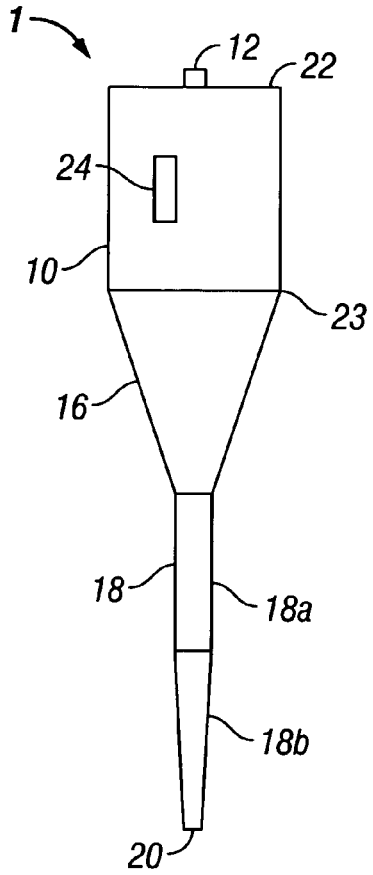
FIG. 6 shows another embodiment of the invention.

FIG. 6 shows another embodiment of the invention, in which segment 18 comprises a first section 18*a*, which is substantially a right cylinder and a second section 18*b* which is a tapered cylinder, or frustoconical shaped segment. In this embodiment, in which a first section 18*a* of segment 18 is a right cylinder, the second section 18*b* may have a greater cone angle than the cone angle of segment 18 of the embodiment shown in FIG. 1 in which substantially the entirety of tubular segment 18 is frustoconical.

Figure 7:
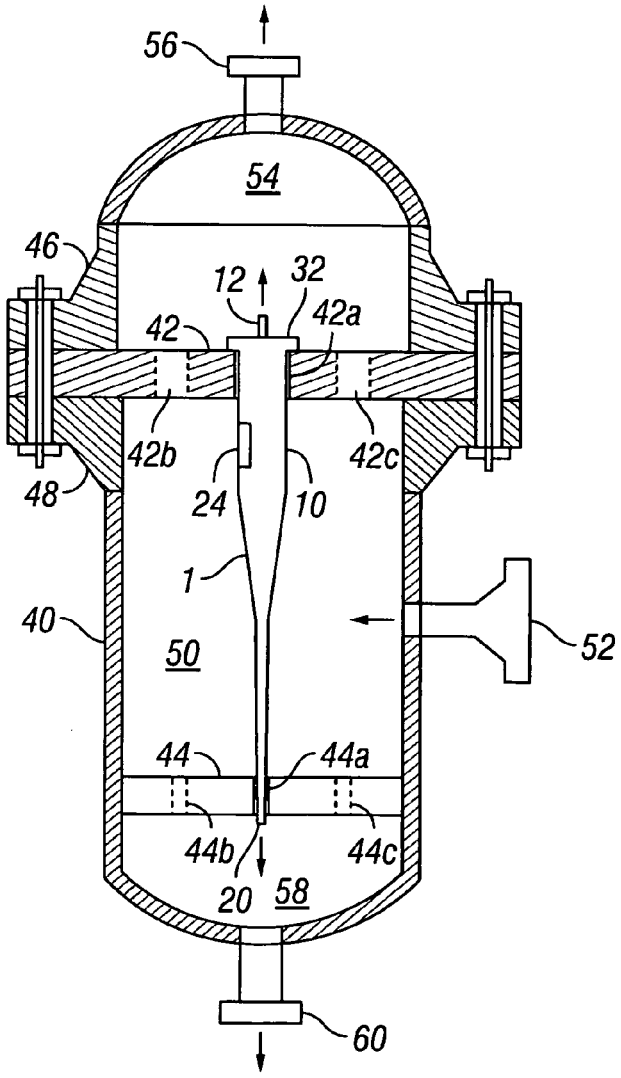
FIG. 7 shows the hydrocyclone mounted inside a pressure vessel

Typically, a plurality of hydrocyclones will be utilized in a common assembly, utilizing a manifold or a pressure vessel in a manner well known to those of ordinary skill in the art. When utilized offshore, where it is more important to minimize space and weight, hydrocyclones are typically deployed in a pressure vessel, which may be similar to pressure vessel 40 illustrated in FIG. 7. FIG. 7 shows a single hydrocyclone 1 within pressure vessel 40, which is shown in cross-section. Hydrocyclone 1 is secured within pressure vessel 40 by means of overflow tube sheet 42 and underflow tube sheet 44. Segment 10 of hydrocyclone 1 is inserted in receptacle 42*a* in overflow tube sheet 42, and the third segment 18 of hydrocyclone 1 is inserted through receptacle 44*a* in underflow tube sheet 44. O-rings (not specifically shown) may be used to seal the hydrocyclone elements within the tube sheets. FIG. 7 shows openings 42*b* and 42*c* in tube sheet 42, and openings 44*b* and 44*c* in tube sheet 44 for accommodating additional hydrocyclones within pressure vessel 40. Overflow tube sheet 42 is mounted between first body flange 46 and second body flange 48 for structural integrity. Underflow tube sheet 44 may be welded to the interior of vessel 40 as shown in FIG. 7, but underflow tube sheet 44 could also be mounted between flanges in a manner similar to overflow tube sheet 42. Cap 32 which includes overflow outlet 12 may be mounted onto the top portion of substantially cylindrical first segment 10 after it is secured within overflow tube sheet 42 or cap 32 may be cast or welded as an integral part of first segment 10.

The fluid mixture is propelled into cavity 50 of pressure vessel 40 through vessel inlet nozzle 52. The water-oil mixture then enters the hydrocyclone through flow inlet 24. The separated oil exits the hydrocyclone through overflow outlet 12 and is collected in overflow collection chamber 54, before exiting through nozzle 56. The separated water exits the hydrocyclone through underflow outlet 20 and is collected in underflow collection chamber 58, before exiting nozzle 60. In one implementation, the pressure at vessel inlet 52 is maintained at 150 psig, while the pressure at underflow nozzle 50 is maintained at 100 psig and the pressure at the overflow nozzle 60 is maintained at 50 psig. Those of ordinary skill in the art may determine that for specific designs, other pressure levels may be more appropriate.

Although the invention may be particularly for the separation of an oil-water mixture, the invention may be utilized for separating fluid mixtures other than water-oil mixtures. For example, the fluid mixture to be separated may be a liquid-solid mixture, a gas-liquid mixture, or a mixture of two liquids.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention.

What is claimed is:

1. A hydrocyclone comprising:

a first segment comprising a fluid inlet, an overflow outlet and a single spiral fluid ramp having a first end and a second end, said first end of said single spiral fluid ramp being in fluid communication with and extending from said fluid inlet;

a second segment comprising a frustoconical segment having a wider end and a narrower end, the second end of said single spiral fluid ramp connected in fluid communication with the wider end of said frustoconical segment, the single spiral fluid ramp being tapered along a length of the single spiral ramp extending from the fluid inlet to the frustoconical segment, so that the cross-sectional area of the single spiral fluid ramp at the second end thereof is less than the cross-sectional area at the first end thereof, thereby achieving an increase in the speed of fluid flowing into the frustoconical segment; and a third segment comprising a tubular element having a first and second end, the first end of said tubular element being in fluid communication with and extending from the narrower end of said frustoconical segment, and said tubular element having an underflow outlet in the second end of said tubular element.

2. The hydrocyclone of claim 1 wherein the fluid inlet is matched to the single spiral fluid ramp.

3. The hydrocyclone of claim 1 wherein the fluid inlet is matched to the single spiral fluid ramp so that fluid entering the single spiral ramp does not encounter a direct directional change so the fluid flows through the inlet and enters the single spiral ramp so that no substantial turbulence is introduced into fluid flowing through the fluid inlet into the single spiral ramp.

4. The hydrocyclone of claim 1 wherein said tubular element is frustoconical with the second end thereof being narrower than the first end thereof.

5. The hydrocyclone of claim 1 wherein said tubular element comprises a first segment that is substantially a right cylinder and a second segment that is frustoconical.

* * * * *